US006745757B2

(12) United States Patent
Sims

(10) Patent No.: US 6,745,757 B2
(45) Date of Patent: Jun. 8, 2004

(54) VIBRATION DECAY MODIFYING ACCESSORIES AND METHODS OF MAKING THE SAME

(76) Inventor: Steve Sims, Sims Vibration Laboratory, 301 W. Business Park Loop, Shelton, WA (US) 98584

( * ) Notice: Subject to any disclaimer, the term of this patent is extended or adjusted under 35 U.S.C. 154(b) by 0 days.

(21) Appl. No.: 09/770,768

(22) Filed: Jan. 25, 2001

(65) Prior Publication Data

US 2002/0088448 A1 Jul. 11, 2002

Related U.S. Application Data

(60) Provisional application No. 60/178,552, filed on Jan. 26, 2000.

(51) Int. Cl.[7] ..... F41B 5/20

(52) U.S. Cl. ..... 124/89

(58) Field of Search ..... 124/89; 188/378

(56) References Cited

U.S. PATENT DOCUMENTS 3,412,725 A * 11/1968 Hoyt
4,615,327 A * 10/1986 Saunders ..... 124/89
5,339,793 A * 8/1994 Findley ..... 124/89
5,471,969 A * 12/1995 McDonald ..... 124/89

* cited by examiner

*Primary Examiner*—John A. Ricci
(74) *Attorney, Agent, or Firm*—Richard D. Multer

(57) ABSTRACT

An accessory for modifying the decay pattern of vibrations set up in an implement to which the accessory is attached, and the combination of a decay pattern modifying accessory and an implement. Methods of manufacturing decay pattern modifying accessories are also disclosed.

32 Claims, 3 Drawing Sheets

VIBRATION DECAY MODIFYING ACCESSORIES AND METHODS OF MAKING THE SAME

CROSS-REFERENCE TO RELATED APPLICATION

This is related to U.S. Provisional Patent application Serial No. 60/178,552, filed Jan. 26, 2000 now abandoned. The benefit of the filing date of that application is hereby claimed.

TECHNICAL FIELD OF THE INVENTION

The present invention relates to novel accessories for archery bows and, more particularly, to such accessories which are capable of significantly reducing both bow jump and the noise made when an arrow is released.

BACKGROUND OF THE INVENTION

U.S. Pat. Nos. 6,298,842 and 6,237,584 disclose archery bow accessories respectively identified in the commercial world by the names LIMB SAVER™ and STRING LEECH™.

A LIMB SAVER™ is an accessory that can be attached to the limbs of a bow and/or to the outer end of the stabilizer of a bow equipped with an accessory of that character to reduce the adverse effect of the vibrations set up in the bow when an arrow is released.

A STRING LEECH™ is designed to reduce the noise generated when an arrow is released. Devices with this objective are known in the trade as string silencers.

One type of STRING LEECH™ string silencer is knotted onto a bowstring, one at each end of the string. A second type of STRING LEECH™ is installed between two parts of a split bowstring and retained in place by complementary elements of the silencer.

SUMMARY OF THE INVENTION

There have now been invented and disclosed herein certain new and novel archery bow accessories which are also designed to reduce the noise made when an arrow is released and, in addition, to significantly reduce bow jump caused by release of the arrow. These shock absorbing accessories are attached to the riser of the bow. They can be used alone or in combination with LIMB SAVER™ and STRING LEECH™ accessories and/or in combination with other devices designated to attenuate the adverse effect on accuracy attributable to bow jump and noise when an arrow is released.

An accessory employing the principles of the present invention is attached to the riser of a bow, typically using the drilled and tapped hole provided for a conventional bow stabilizer.

The novel shock absorbing accessories disclosed herein are made up of a rigid transfer rod or transfer rod assembly, a viseo-elastic shock absorbing component, and a compression ring. When an arrow is released, vibrations set up in the bow are transferred to the riser with the transfer rod (or assembly) directing vibrations from the riser to the shock absorbing component of the accessory. The shock absorbing material reduces the time for which vibrations of a character that might effect accuracy are felt by the user. Also, the shock absorbing material causes maximum energy to be transferred to the arrow being released.

The shock absorbing component of the accessory is very effective, in part because it is preloaded as the accessory is assembled. The compression ring keeps the shock absorbing component in its compressed, preloaded state.

Shock absorber accessories as disclosed herein work well both with double cam bows—where the entire bow tends to jump forward when an arrow is released—and single cam bows—where the bottom of the bow tends to kick forward and upward on arrow release.

Accessories as disclosed herein are also relatively light, which is another significant advantage of these products.

The performance of a bow equipped with an accessory as disclosed herein can be enhanced by attaching a bow stabilizer or a vibration pattern modifier of the character disclosed in U.S. Pat. No. 6,298,842 to the accessory.

DETAILED DESCRIPTION OF THE INVENTION

Figure 1:
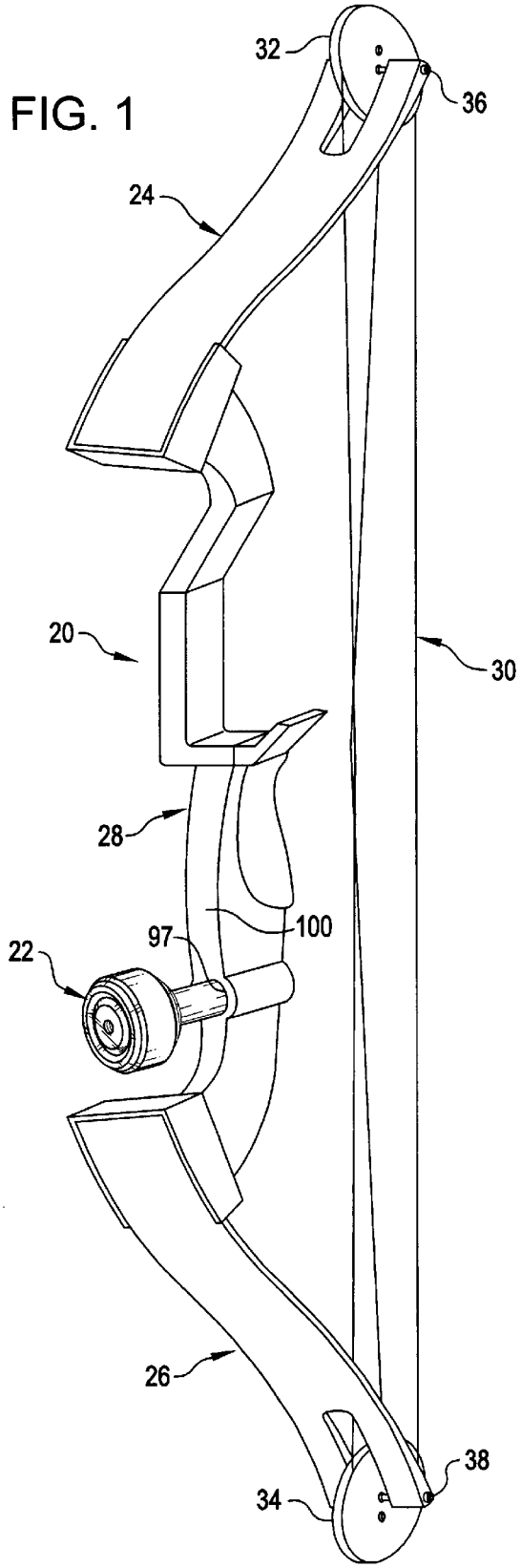
FIG. 1 is a pictorial illustration of a compound bow equipped with a shock absorbing accessory embodying the principles of the present invention and provided to reduce bow jump and noise when an arrow is released.

Referring now to the drawings, FIG. 1 depicts a compound bow 20 equipped with a vibration decay pattern modifying, shock absorber 22 embodying the principles of the present invention. Bow 20 has flexible limbs 24 and 26 mounted to the opposite ends of riser 28 and bow string 30. The bow string is strung around cams 32 and 34 at the ends of limbs 24 and 26 with the ends of the bow string being anchored to shafts 36 and 38 which rotatably support cams 32 and 34 from the limbs 24 and 26 of bow 20.

Figure 2:
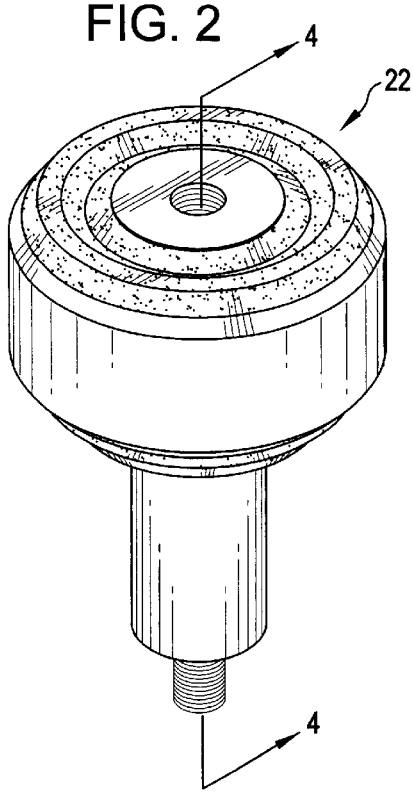
FIG. 2 is a perspective view of the shock absorbing accessory.
Figure 3:
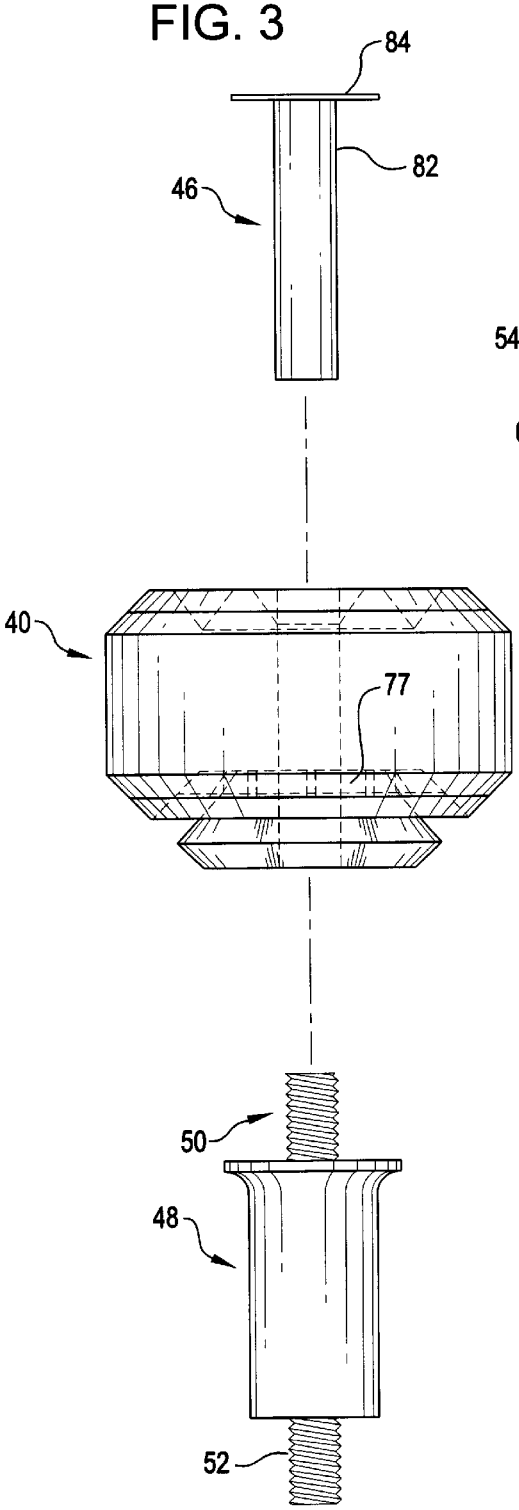
FIG. 3 is an exploded view of the shock absorbing accessory.
Figure 4:
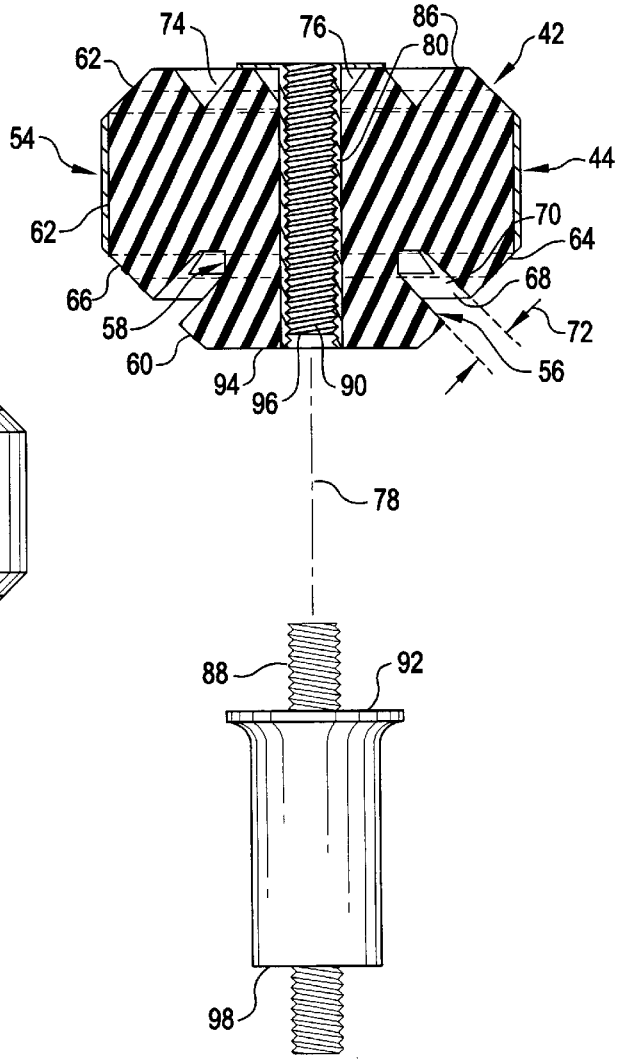
FIG. 4 is a view similar to FIG. 3 but with a shock absorbing component of the accessory shown in section taken substantially along line 4—4 of FIG. 2.

As is best shown in FIGS. 2–4, the vibration decay modifying accessory 22 has a unit 40 made up of elastomeric decay pattern modifying, elastomeric component 42 surrounded by a compression ring 44; a flanged tube 46 with integrated internal threads 90, and a flanged vibration transfer component 48 with integrated, externally threaded elements 50 and 52 at its opposite ends.

Referring now primarily to FIGS. 3 and 4, the elastomeric component 42 of unit 40 has a circular profile (see FIG. 2). The major elements of component 42 are a head 54 and an integral, depending stem 56 with straight and beveled conical profile elements 58 and 60. The head 54 of component 42 has a vertical edge 63 between two, integral, tapered edges 62 and 64. The lower part of head 54 constitutes a skirt 66 with an inner edge 68 which is concentrically spaced about the lower part of head 54 and its inner edge 70. This leaves a gap 72 between the head 54 and stem 56 of component 54, which allows decay pattern modifying movement of head 54 relative to stem 56.

Decay pattern modifying movement of head 54 is further promoted by concentric, inverted pyramid grooves 74 and 76 in the upper part 62 of head 54 and by pockets or recesses which are equiangularly spaced around the periphery of integral stem element 56. These pockets, all identified by reference character 77 (see FIG. 3) for the sake of convenience, have closed inner ends and open onto the groove 72 between head and stem components 54 and 56.

The stem 56 of decay pattern modifying, elastomeric component 42 can vibrate or oscillate in directions generally normal to the longitudinal axis 78 of accessory 22 in any and all directions around the circumference of the transfer component 48. At the same time, head 54 of the component 42 can oscillate laterally and vertically (with that component oriented as shown in FIG. 4), and the edge portion 63 can also oscillate around the circumference of the head in directions generally paralleling axis 78.

The effectiveness of accessory 22 is promoted by preloading the elastomeric component 42 of the accessory. Preloading is accomplished by first installing the elastomeric component 42 in ring 44, which generally spans the edge element 63 of head 54. Next, flanged component 46 is installed in a central bore 80 extending from top to bottom through elastomeric component 42 with a tubular element 82 of component 46 located in, and extending from the top to the bottom of component 42 and with a flange 84 of component 46 butting the top edge 86 of the elastomeric component 42. Next, the externally threaded element 50 of vibration transfer component 48 is threaded into the tubular element 82 of component 46, the external threads 88 on element 50 engaging the complimentary internal threads 90 in tubular element 82 and drawing components 46 and 48 together until the flange 92 on component 48 engages, and presses against, the bottom edge 94 of elastomeric component stem 56, squeezing elastomeric component 42 in a vertical direction. This action generates a laterally extending force which is maintained in element 42 by the tubular element 82 of component 46 and compression ring 44, which keep component 42 from expanding inwardly or outwardly by effective "squeezing."

The rotation of component 48 in sleeve 82 is continued until the flange 92 of component 48 engages the lower end 96 of tubular element 82. As best shown in FIG. 4, this end 96 is spaced from the bottom 94 of elastomeric component stem 56. The load applied to elastomeric component 42 can be provided at a selected level by adjusting this spacing.

Accessory 22 is, in the illustrated, exemplary application of the invention, mounted to the riser 28 of bow 20 by threading element 52 of accessory component 48 into a drilled and tapped, blind aperture 97 in the riser until the bottom or lower edge 98 of the accessory component element 48 is seated on, and frictionally engaged with, the front edge 100 of riser 28.

Figure 5:
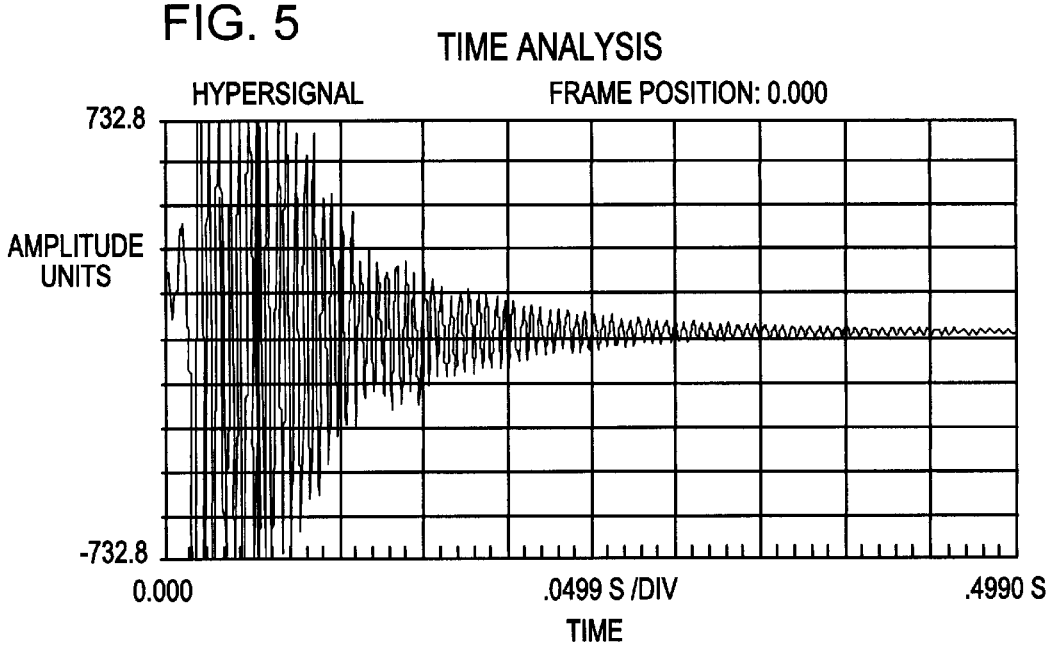
FIG. 5 is a graph showing the shock imparted to a representative compound bow when an arrow is released.
Figure 6:
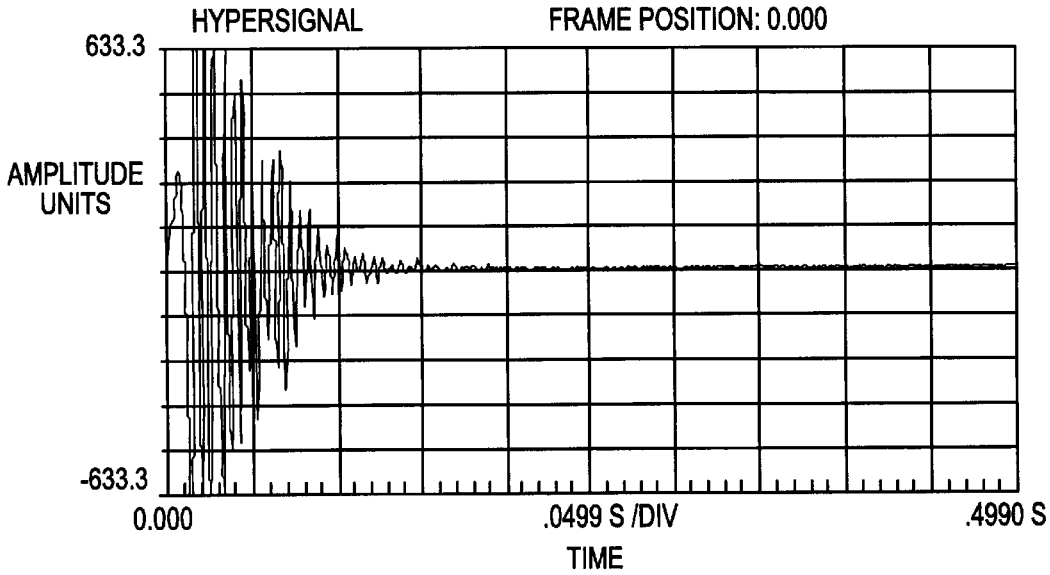
FIG. 6 shows how the shock is reduced when the bow is fitted with a shock absorbing accessory as shown in FIGS. 1–4.

FIGS. 5 and 6 compare the decay pattern of a bow such as the one illustrated in FIG. 1 without an accessory as disclosed herein (FIG. 5) with the decay pattern for the same bow equipped with an accessory of the character identified by reference character 22. It will be apparent to the reader that accessory 22 significantly shortens the decay time of the vibrations set up in the bow when an arrow is released, especially those larger and consequently more deleterious vibrations. The result is a significant advantage. The practical result, as discussed above, is a marked reduction both in bow jump when an arrow is released and the noise generated when that action occurs.

The shock absorbing elastomeric component 42 (see FIG. 4) of the present invention is preferably fabricated from a soft, viseo-elastic material with a Shore A hardness in the range of 3 to 20.

One suitable viseo-elastic material is NAVCOM™. NAVCOM™ is a soft, amorphous, rubber-like material which contains a mixture of chloroprene and butyl polymers and has the following physical properties (representative).

| Shore A hardness: 17–90 | | | | | |
|---|---|---|---|---|---|
| Environment | Shore A | Ultimate Elongation (Percent) | Tensile Strength (PSI) | Compression Set (Percent) | Specific Gravity |
| | 7 | 1,075 | 373 | 6.01 | 1.014 |
| | 12 | 900 | 643 | 7.3 | 1.025 |
| | 20 | 835 | 1,069 | 6.9 | 1.063 |
| | 30 | 1,056 | 1,621 | 4.0 | 1.074 |
| | 40 | 326 | 1,453 | N/A | 1.185 |
| | 90 | 175 | 2,440 | N/A | 1.379 |
| Oven aged | 7 | N/A | N/A | 56.3 | — |
| for | 12 | — | — | 31.1 | — |
| 70 hrs at | 20 | — | — | 30.8 | — |
| 212 ± 5° F. | 40 | — | — | 22.4 | — |
| | 90 | — | — | 18.6 | — |

| | |
|---|---|
| Resilience: | At room temperature - Medium<br>At high temperature - Fairly high |
| Heat resistance | Good |
| Outdoor aging resistance: | Excellent |
| Low temp flexibility: | Good |
| Abrasion resistance: | Good |
| Flex life: | Good |
| Solvent resistance: | |
| Hydrocarbons - | Fair to good |
| Oxygenated - | Fair to good |
| Air permeability: | Low to moderate |
| Moisture resistance: | Fair |
| Useful operating temperature: | −40° to 250° F. |

While the invention is described and illustrated here in the context of a preferred embodiment, the invention may be embodied in many forms without departing from the spirit or the essential characteristics of the invention. The present embodiments are therefore to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. The combination of an archery bow and an accessory for modifying the decay pattern of vibrations set up in said bow when an arrow is released:

said bow comprising a riser and limbs extending in opposite directions from first and second, opposite ends of the riser; and said accessory consisting essentially of:

a first, preloaded, elastomeric component;

a compression ring which is fabricated from a rigid material surrounds said elastomeric component, and is dimensioned to maintain the elastomeric component in the pre-loaded state; and a transfer arrangement for transferring shocks and vibrations generated in the bow when an arrow is released to said elastomeric component and for mounting the accessory to the bow.

2. A combination as defined in claim 1:

which comprises an arrangement for pre-loading said polymeric component; and wherein said compression ring is dimensioned to maintain the polymeric component in a preloaded state.

3. A combination as defined in claim 2 wherein the arrangement for preloading the polymeric component of the accessory comprises:

a flanged component and said transfer arrangement;

said flanged component having a flange engaging a first side of said polymeric component;

said transfer arrangement having a flange engaging a second, opposite side of said polymeric component; and said flanged component and said transfer arrangement being relatively rotatable such that relative rotation of the flanged component and the transfer arrangement draws the flanges of the flanged component and the transfer arrangement together to preload the polymeric component.

4. A combination as defined in claim 1 wherein the transfer arrangement comprises a transfer rod, said transfer rod being fixed at one end thereof to the riser of the bow.

5. A method of manufacturing a vibration absorbing accessory for archery bows, said method comprising the steps of:

providing a viseo-elastic shock absorbing component with a bore therethrough;

installing said shock absorbing component in an annulus of rigid material;

installing in the bore of the shock absorbing component a second component which has features for attaching the accessory to the riser of the bow and for loading the shock absorbing component by compressing said component against said rigid annulus.

6. The combination of an archery bow and an accessory for modifying the decay pattern of vibrations set up in said bow when an arrow is released:

said bow comprising a riser and limbs extending in opposite directions from first and second, opposite ends of the riser; and said accessory comprising:

a first, pre-loaded, elastomeric component;

a second component fabricated from a rigid material surrounding said elastomeric component; and a transfer arrangement for transferring shocks and vibrations generated in the bow when an arrow is said elastomeric component;

the transfer arrangement comprising a transfer rod fixed at one end thereof to the riser of the bow; and a flanged component which has an internally threaded element;

said transfer rod having a second, externally threaded element at said one end thereof and said second, externally threaded element attaching the transfer rod to the riser of the bow.

7. A combination as defined in claim 6 wherein a flange of the flanged component is located at and integral with the one end of the transfer rod.

8. The combination of an archery bow and an accessory for modifying the decay pattern of vibrations set up in said bow when an arrow is released:

said bow comprising a riser and limbs extending in opposite directions from first and second, opposite ends of the riser; and said accessory comprising:

a first, pre-loaded, elastomeric component;

a second component fabricated from a rigid material surrounding said elastomeric component; and a transfer arrangement for transferring shocks and vibrations generated in the bow when an arrow is released to said elastomeric components;

the elastomeric component having a circularly sectioned head and a stem integrated with the head at one side of the head.

9. A combination as defined in claim 8 in which said head has a skirt surrounding at least a portion of the stem nearest the head.

10. A combination as defined in claim 8 in which there are concentric grooves in a second, opposite side of the head.

11. A combination as defined in claim 8 in which, in that side of the polymeric component head with which the skirt is integrated:

there is a surface spaced from the stem of said polymeric component; and there are pockets which are formed in said head and open onto said surface.

12. The combination of an archery bow and an accessory for modifying the decay pattern of vibrations set up in said bow when an arrow is released:

said bow comprising a riser and limbs extending in opposite directions from first and second, opposite ends of the riser; and said accessory comprising:

a first, pre-loaded, elastomeric component;

a second component fabricated from a rigid material surrounding said elastomeric component; and a transfer arrangement for transferring shocks and vibrations generated in the bow when an arrow is released to said elastomeric components;

said accessory having a first end at which the accessory is attached to the riser of the bow; and there being a vibration decay pattern modifier fixed to a second, outer end of the accessory;

said decay pattern modifier having a head and a stem integrated with the stem; and said decay pattern modifier being fabricated in its entirety from an elastomeric polymer.

13. The combination of an archery bow and an accessory for modifying the decay pattern of vibrations set up in said bow when an arrow is released:

said bow comprising a riser and limbs extending in opposite directions from first and second, opposite ends of the riser; and said accessory comprising:

a first, pre-loaded, elastomeric component;

a second component fabricated from a rigid material surrounding said elastomeric component; and a transfer arrangement for transferring shocks and vibrations generated in the bow when an arrow is released to said elastomeric component;

said accessory being fixed at one end thereof to and extending from the riser of the bow; and the combination further comprising a bow stabilizer fixed to and extending from a second, exposed end of the accessory in axial alignment with the accessory.

14. A combination as defined in claim 13 wherein:

said accessory comprises an internally threaded component extending through the elastomeric component; and said stabilizer comprises a component with complementary external threads.

15. An accessory for modifying the decay pattern of vibrations set up in an artifact to which the accessory is attached, said accessory comprising:

a first, pre-loaded viseo-elastic, polymeric component;

a compression ring fabricated of a rigid material, said compression ring surrounding said polymeric component and maintaining the first component in its pre-loaded state;

a mechanism for pre-loading said polymeric component; and a mechanism comprising a transfer rod for transmitting vibrations to said first elastomeric component;

the mechanism for pre-loading said polymeric component comprising a flanged component and said transfer mechanism;

said flanged component having a flange engaging a first side of said polymeric component;

said transfer mechanism having a flange engaging a second, opposite side of said polymeric component; and said flanged component and said transfer mechanism being relatively rotatable such that relative rotation of the flanged component and the transfer mechanism draws the flanges of the flanged component and the transfer mechanism together to pre-load the polymeric component.

16. An accessory as defined in claim 15 wherein a flange of the flanged component is located at and integral with the one end of the transfer rod.

17. An accessory for modifying the decay pattern of vibrations set up in an artifact to which the accessory is attached, said accessory comprising:

a first, preloaded elastomeric component; and a second component fabricated of a rigid material, said second component surrounding the first, elastomeric component and maintaining the first component in its pre-loaded state;

the polymeric component having a circularly sectioned head; and the accessory further comprising a stem integrated with the head of the polymeric component at one side of said head.

18. An accessory as defined in claim 17 in which said head has a skirt surrounding at least a portion of the stem nearest the head.

19. An accessory as defined in claim 17 in which there are concentric grooves in a second, opposite side of the head.

20. An accessory as defined in claim 17 in which, in that side of the polymeric component head with which the skirt is integrated:

there is a surface spaced from the stem of said polymeric component; and there are pockets which are formed in said head and open onto said surface.

21. An accessory for modifying the decay pattern of vibrations set up in an artifact to which the accessory is attached, said accessory comprising:

a first, pre-loaded elastomeric component;

a second component fabricated of rigid material, said second component surrounding the elastomeric component and maintaining said elastomeric component in its preloaded state; and a third component extending through the elastomeric component;

there being first and second flanges on opposite end of the third component which engage opposite ends of the elastomeric component; and the relative distance between the opposite ends of the elastomeric component and the opposite ends of the third component being such that the elastomeric component is compressed between the first and second flanges of said third component to also maintain the elastomeric component in its pre-loaded state.

22. An accessory as defined in claim 21 which further comprises a fastener for so attaching the accessory to an artifact equipped with said accessory as to produce vibration transmitting contact between the artifact and said third accessory component.

23. An accessory as defined in claim 22 in which:

the third component has a hollow interior;

one of the said first and second flanges of the third component is apertured;

said fastener has: (a) a head which is trapped in the third component by the flange, and (b) a threaded stem which extends through the apertured flange to the exterior of that component.

24. An accessory for modifying the decay pattern of vibrations set up in an artifact to which the accessory is attached, said accessory comprising:

a first, pre-loaded, elastomeric component;

a second component fabricated of a rigid material, said second component surrounding said first, elastomeric component and maintaining the first component in its pre-loaded state;

third and fourth components that cooperate with the second component to place the elastomeric component of the accessory under load;

said third and fourth accessory components having flanges engaging first and second, opposite ends of the elastomeric component; and said third and fourth accessory components being so threadably engaged that rotation of one of those components relative to the other draws the flanges of the third and fourth components together to compress the elastomeric component between those flanges.

25. An accessory as defined in claim 24:

which further comprises a fastener for attaching the accessory to an artifact equipped with the accessory;

said accessory further comprising a fastener retainer removably assembled to one of said third and fourth components;

the fastener having a head and an integral threaded shank; and the retainer having a cavity configured to trap the head of the fastener therein and an aperture communicating with the cavity through which the fastener shank extends.

26. An accessory as defined in claim 25 wherein said retainer has a surface onto which the aperture opens and wherein said surface is configured to so fit against an artifact equipped with the accessory as to transmit vibrations to the accessory component to which the fastener retainer is assembled.

27. The combination of an archery bow and an accessory for modifying the decay pattern of vibrations set up in said bow when an arrow is released:

said bow comprising a riser and limbs extending in opposite directions from first and second, opposite ends of the riser; and said accessory comprising:

a first pre-loaded, elastomeric component; a compression ring which is fabricated from a rigid material, surrounds said elastomeric component and is dimensioned to maintain the elastomeric component in the pre-loaded state;

a transfer arrangement for transferring shocks and vibrations generated in the bow when an arrow is released to said elastomeric component; and an arrangement for pre-loading the elastomeric component of the accessory which comprises a flanged component and said transfer arrangement;

said flanged component having a flange engaging a first side of said polymeric component.

28. An accessory for modifying the decay pattern of vibrations set up in an artifact with which the accessory is associated, said accessory consisting essentially of:

a first, preloaded, elastomeric component;

a second component for maintaining the first component in its preloaded state, said second component: (a) being fabricated from a rigid material, and (b) surrounding and embracing the first component and forming a unified assemblage with the first component; and a mechanical fastener for mounting the unified assemblage to the artifact with which the accessory is associated.

29. An accessory for modifying the decay pattern of vibrations set up in an artifact with which the accessory is associated, said accessory consisting essentially of:

a first, preloaded, elastomeric component;

a compression ring for maintaining the first component in its preloaded state, said compression ring surrounding and embracing the first component and forming a unified assemblage with the first component; and a mechanical fastener for mounting the unified assemblage to the artifact with which the accessory is associated.

30. An accessory for modifying the decay pattern of vibrations set up in an artifact with which the accessory is associated, said accessory consisting essentially of:

a first, preloaded, elastomeric component;

a second component for maintaining the first component in its preloaded state, said second component: (a) being fabricated from a rigid material, and (b) surrounding and embracing the first component and forming a unified assemblage with the first component;

a mechanical fastener for mounting the unified assemblage to the artifact with which the accessory is associated;

a transfer mechanism for transmitting vibrations: (a) from an artifact to which the accessory is attached (b) to the accessory.

31. An accessory for modifying the decay pattern of vibrations set up in an artifact with which the accessory is associated, said accessory consisting essentially of:

a first, elastomeric component a compression mechanism for preloading the elastomeric component;

a second component for maintaining the first component in its preloaded state, said second component: (a) being fabricated from a rigid material, and (b) surrounding and embracing the first component and forming a unified assemblage with the first component;

a mechanical fastener for mounting the unified assemblage to the artifact with which the accessory is associated; and a transfer mechanism for transmitting vibrations: (a) from an artifact to which the accessory is attached (b) to the accessory.

32. An accessory for modifying the decay pattern of vibrations set up in an artifact with which the accessory is associated, said accessory consisting essentially of:

a first, preloaded, elastomeric component;

a second component for maintaining the first component in its preloaded state, said second component: (a) being fabricated from a rigid material, and (b) surrounding and embracing the first component and forming a unified assemblage with the first component;

a mechanical fastener for mounting the unified assemblage to the artifact with which the accessory is associated; and a transfer mechanism optionally including the mechanical fastener for transmitting vibrations from the artifact to which the accessory is attached (a) from the artifact (b) to the accessory.

* * * * *